US009333133B2

(12) United States Patent
Serhan

(10) Patent No.: US 9,333,133 B2
(45) Date of Patent: May 10, 2016

(54) WHEELCHAIR HAVING AN ADJUSTABLE SEAT

(71) Applicant: Drive Medical Design & Manufacturing, Port Washington, NY (US)

(72) Inventor: Michael Serhan, Acadia, CA (US)

(73) Assignee: Drive Medical Design & Mfg., Port Washington, NY (US)

( * ) Notice: Subject to any disclaimer, the term of this patent is extended or adjusted under 35 U.S.C. 154(b) by 27 days.

(21) Appl. No.: 14/329,417

(22) Filed: Jul. 11, 2014

(65) Prior Publication Data

US 2014/0319891 A1 Oct. 30, 2014

Related U.S. Application Data

(63) Continuation of application No. 13/873,450, filed on Apr. 30, 2013, now Pat. No. 8,801,100, which is a continuation of application No. 13/117,481, filed on May 27, 2011, now Pat. No. 8,449,032.

(60) Provisional application No. 61/349,295, filed on May 28, 2010.

(51) Int. Cl.
*A47C 7/14* (2006.01)
*A61G 5/10* (2006.01)

(52) U.S. Cl.
CPC ..... *A61G 5/1064* (2013.01); *A61G 2200/18* (2013.01)

(58) Field of Classification Search
CPC ..... A47C 7/282; A47C 5/06; A47C 4/02; B60N 2/62; B60N 2/66
USPC ..... 297/452.56, 452.63, 452.64, 440.24, 297/284.11, 284.2; 280/250.1, 304.1
See application file for complete search history.

(56) References Cited

U.S. PATENT DOCUMENTS

| | | | |
|---|---|---|---|
| 2,836,833 | A | 6/1958 | Carlson |
| 3,333,841 | A | 8/1967 | Damiano |
| 3,464,479 | A | 9/1969 | Baker |
| 4,685,738 | A | 8/1987 | Tinus |
| 4,910,817 | A | 3/1990 | Kita |
| 5,564,786 | A | 10/1996 | Peek et al. |
| 5,582,463 | A | 12/1996 | Linder et al. |
| 5,588,708 | A | 12/1996 | Rykken et al. |
| 5,954,402 | A | 9/1999 | McInturff |
| 5,984,418 | A | 11/1999 | McInturff |
| 6,454,353 | B1 | 9/2002 | Knaus |
| 6,536,791 | B1 | 3/2003 | Adams |

(Continued)

*Primary Examiner* — David E Allred
*Assistant Examiner* — Alexander Harrison
(74) *Attorney, Agent, or Firm* — Carter, DeLuca, Farrell & Schmidt, LLP

(57) ABSTRACT

A wheelchair having an adjustable seat includes a seat frame including first and second side support members. The side support members are extendable between a first position defining a first length and a second position defining a second length greater than the first length. A seat member is coupled at a first side thereof to the first side support member and at a second side thereof to the second side support member. The seat member extends between the first and second side support members to define a seat area having an initial depth corresponding to the first length of the side support members and a width corresponding to a distance between the side support members. The seat member includes an auxiliary portion for extending the seat member to an extended depth corresponding to the second length of the side support members.

9 Claims, 6 Drawing Sheets

(56) References Cited

U.S. PATENT DOCUMENTS

| | | | |
|---|---|---|---|
| 6,913,318 | B2 | 7/2005 | Higley et al. |
| 7,108,322 | B2 | 9/2006 | Erker |
| 7,344,197 | B2 | 3/2008 | Sanderson |
| 7,374,189 | B1 | 5/2008 | Adams |
| 7,455,366 | B2 | 11/2008 | Kawasaki |
| 7,520,518 | B2 | 4/2009 | Peterson et al. |
| 7,669,936 | B2 | 3/2010 | Aubriet et al. |
| 7,874,621 | B2 | 1/2011 | Gumbrich et al. |
| 8,011,728 | B2 | 9/2011 | Kohl et al. |
| 8,424,896 | B2 | 4/2013 | Balcom et al. |
| 8,449,032 | B2 | 5/2013 | Serhan |
| 2002/0113473 | A1 | 8/2002 | Knaus |
| 2003/0001424 | A1 | 1/2003 | Mundell et al. |
| 2003/0062757 | A1 | 4/2003 | Calvery |
| 2004/0041453 | A1 | 3/2004 | Ellis et al. |
| 2007/0102985 | A1 | 5/2007 | Taniguchi et al. |
| 2008/0157577 | A1 | 7/2008 | Lindsay |
| 2010/0109401 | A1 | 5/2010 | Booth et al. |
| 2011/0006582 | A1 | 1/2011 | Carlson et al. |
| 2011/0254335 | A1 | 10/2011 | Pradier et al. |

WHEELCHAIR HAVING AN ADJUSTABLE SEAT

CROSS-REFERENCE TO RELATED APPLICATION

The present application is a continuation application of U.S. patent application Ser. No. 13/873,450 entitled "Wheelchair Having an Adjustable Seat," filed Apr. 30, 2013, which is a continuation application of U.S. patent application Ser. No. 13/117,481 entitled "Wheelchair Having an Adjustable Seat," filed on May 27, 2011, now U.S. Pat. No. 8,449,032, which claims priority to, and benefit of, U.S. Provisional Patent Application No. 61/349,295 entitled "Wheelchair Having an Adjustable Seat," filed on May 28, 2010, the entire contents of each of which are hereby incorporated by reference herein.

BACKGROUND

1. Technical Field

The present disclosure relates to a wheelchair and, more particularly, to a wheelchair including an adjustable seat for adjusting a depth of the seat in accordance with a patient's needs.

2. Background of Related Art

Wheelchairs are relatively well known in the art and generally include a frame having a pair of large drive wheels mounted on either side of the frame toward a back end thereof, a pair of small steering wheels mounted on either side of the frame toward a front end thereof, a seat including a base and a back support, and a pair of foot supports extending forwardly from the frame.

More recently, improvements in the design and operation of wheelchairs have lead to the introduction of wheelchairs with additional features such as: motorized drive systems, foldable frames, reclinable seats, and the like. Further, wheelchairs today are often made from durable, lightweight materials and may include adjustable foot supports in an attempt to accommodate patients of different sizes.

However, while these additional features may increase the portability, maneuverability, and/or comfort of the wheelchairs, there is still a need for a wheelchair having a depth-adjustable seat capable of adjusting the depth of the seat according to the physical characteristics and/or medical condition of the patient. Such a wheelchair obviates the need for medical supply stores, nursing homes, hospitals, and the like to carry multiple wheelchairs of varying seat depth in order to accommodate a wider range of patients. In other words, a seat-depth adjustable wheelchair provides a single wheelchair adaptable for use by the young, elderly, handicapped and/or infirm without sacrificing comfort, support, or any of the other advantages of presently-known wheelchairs.

SUMMARY

In accordance with one embodiment of the present disclosure, a wheelchair having an adjustable seat is provided. The adjustable seat of the wheelchair includes a seat frame having first and second side support members. The first and second side support members of the seat frame are extendable between a first position defining a first length and a second position defining a second length that is greater than the first length. A seat member is coupled to the first and second support members at first and second sides thereof, respectively, and extends between the side support members to define a seat area. The seat area defines an initial depth corresponding to the first length of the side support members and a width corresponding to a distance between the side support members. The seat member includes an auxiliary portion configured to permit the seat member to extend to an extended depth corresponding to the second length of the side support members.

In one embodiment, each of the side support members includes an inner shaft and an outer shaft. The outer shaft is telescopically moveable with respect to the inner shaft between a substantially overlapping position corresponding to the first length and an extended position corresponding to the second length.

In another embodiment, each of the side support members includes a locking mechanism for releasably fixing the length of the side support members. More specifically, the locking mechanism may include a set screw that is selectively engageable with the inner and outer shafts of each of the side support members for selectively fixing the position of the inner and outer shafts with respect to one another. Alternatively, the outer shaft may include a plurality of apertures defined therein and positioned therealong and the inner shaft may include a locking pin disposed thereon. In such an embodiment, the locking pin is engageable within each of the apertures for selectively fixing the position of the inner and outer shafts with respect to one another.

In yet another embodiment, the auxiliary portion is positioned intermediate the seat member. In this embodiment, the auxiliary portion is expandable between a collapsed position, wherein the seat member defines the initial depth, and an expanded position, wherein the expanded auxiliary portion extends the seat member to define the extended depth.

In still another embodiment, the auxiliary portion is disposed at a front end of the seat member. In this embodiment, the auxiliary portion is transitionable between a storage position and a use position. When in the storage position, the auxiliary portion is stored underneath the front end of the seat member such that the seat member defines the initial depth. When transitioned to the use position, the auxiliary portion extends forwardly from the seat member such that the seat member is extended the extended depth. The auxiliary portion may further include one (or more) releasable straps, e.g., a VELCRO™ strap, disposed on opposite sides thereof for securing the auxiliary portion to each of the side support members when in the use position. Additionally, a releasable securement mechanism, e.g., VELCRO™, may be provided for retaining the auxiliary portion in the storage position.

In still yet another embodiment, the seat member is formed from a nylon upholstery, although it is envisioned that the seat member be formed from any other suitable material.

In accordance with another embodiment of the present disclosure, an adjustable seat for a wheelchair is provided. The adjustable seat includes first and second side support members that are extendable between a first position defining a first length and a second position defining a second length greater than the first length. A seat member is coupled to the side support members and extends therebetween. The seat member includes an auxiliary portion disposed at a front end thereof that is transitionable between a storage position, wherein the auxiliary portion is stored underneath the front end of the seat member such that the seat member defines an initial depth corresponding to the first length of the side support members, and a use position, wherein the auxiliary portion extends forwardly from the seat member such that the seat member defines an extended depth corresponding to the second length of the side support members.

In one embodiment, the auxiliary portion includes first and second releasable straps disposed at opposite sides thereof for securing the auxiliary portion to the side support members when in the use position.

In another embodiment, each of the side support members includes a locking mechanism for releasably fixing the length of the side support members, e.g., once the side support members are extended to the desired length.

In accordance with yet another embodiment of the present disclosure, an adjustable seat for a wheelchair is provided. Similar to the previous embodiment, the adjustable seat includes first and second side support members that are extendable between a first position defining a first length and a second position defining a second length. A seat member is coupled to each of the side support members and extends therebetween. The seat member includes an auxiliary portion positioned intermediate the seat member that is expandable between a collapsed position, wherein the seat member defines an initial depth corresponding to the first length of the side support members, and an expanded position, wherein seat member defines an extended depth corresponding to the second length of the side support members.

In another embodiment, each side support member includes a locking mechanism for releasably fixing the length of the side support members.

BRIEF DESCRIPTION OF THE DRAWINGS

Various embodiments of the presently disclosed wheelchair are described herein with reference to the drawings wherein.

DETAILED DESCRIPTION

Figure 1:
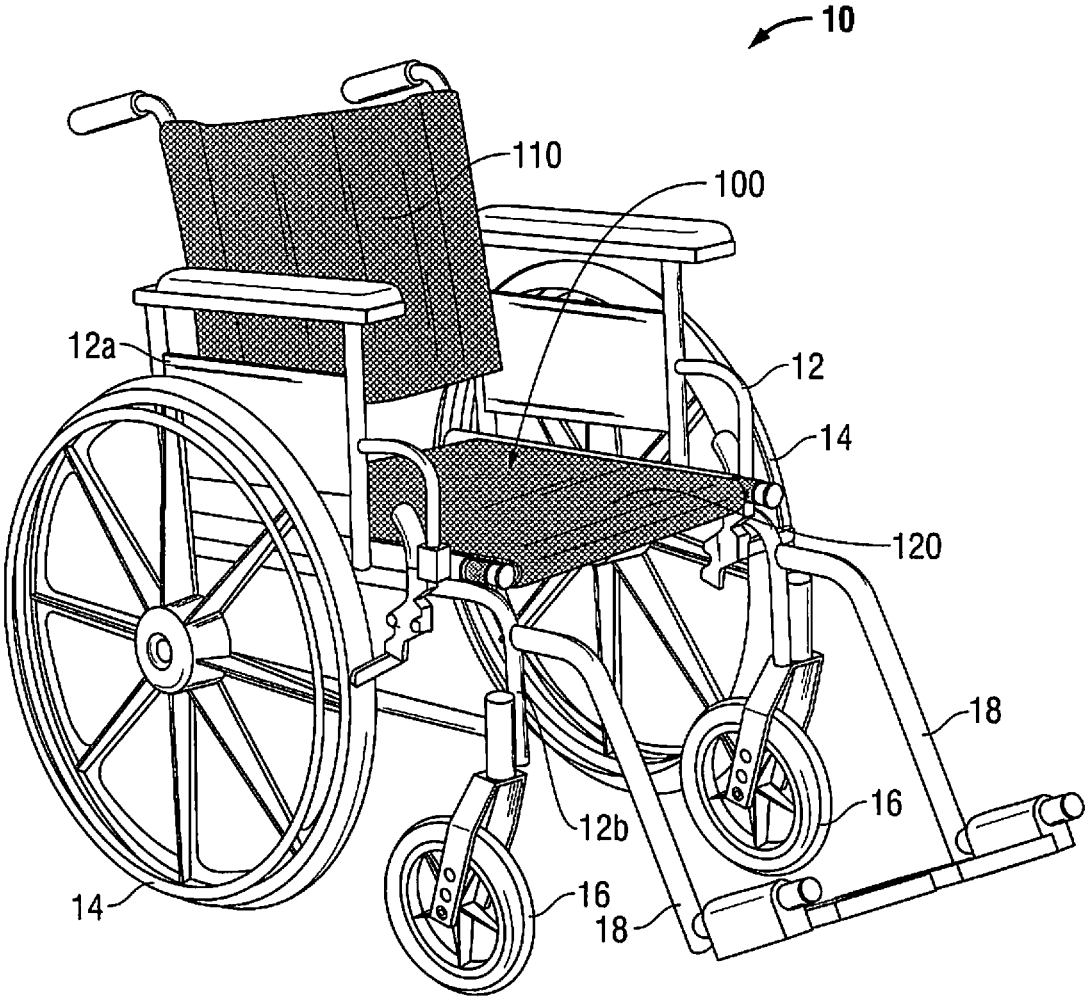
FIG. 1 is a perspective view of one embodiment of a wheelchair provided in accordance with the present disclosure.

Turning now to FIG. 1, a wheelchair in accordance with the present disclosure is shown identified by reference numeral 10. Wheelchair 10 generally includes a frame 12, a pair of large wheels 14 mounted to frame 12 toward a rear end 12*a* thereof, a pair of smaller wheels 16 rotatably coupled to frame 12 toward a forward end 12*b* thereof, and a pair of adjustable foot supports 18 extending forwardly from frame 12. Wheelchair 10 further includes a seat 100 including a seat back support 110 and a seat base 120 defined within frame 12. Wheelchair 10 is shown by way of example, as it is envisioned that wheelchairs of varying size, style and configuration may be used in accordance with the present disclosure.

As will be described in greater detail hereinbelow, seat base 120 of seat 100 is adjustable, or extendable, between a retracted position defining a minimum seat depth, and an extended position defining a maximum seat depth (and intermediate positions therebetween) such that wheelchair 10 can be adjusted to accommodate patients having varying physical characteristics and/or medical conditions. Further, it is envisioned that seat back support 110 of seat 100 be similarly adjustable between a retracted position defining a minimum seat back height, and an extended position defining a maximum seat back height, although the description of such is omitted herein to avoid unnecessary repetition.

Figure 2A:
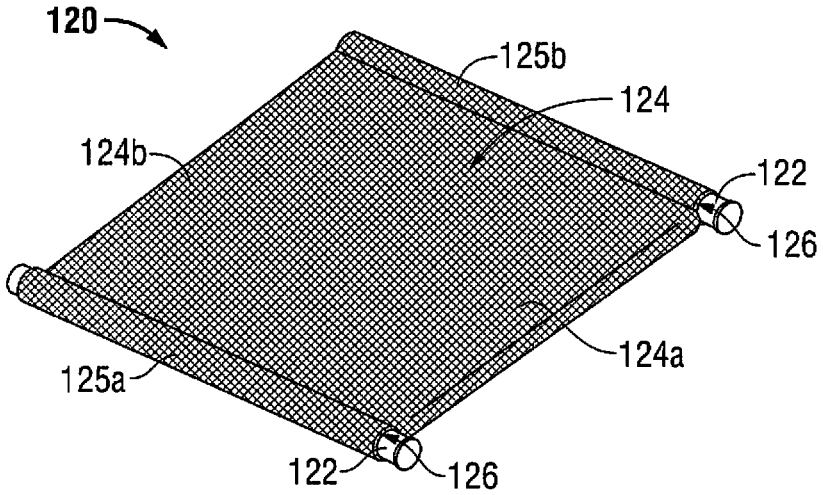
FIG. 2A is a perspective view of one embodiment of an adjustable seat base provided in accordance with the present disclosure and configured for use with the wheelchair of FIG. 1, wherein the seat base is disposed in a retracted position.
Figure 2B:
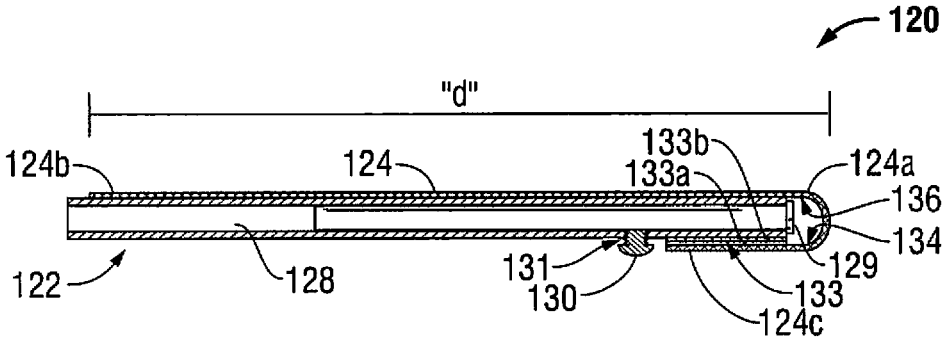
FIG. 2B is a side, cross-sectional view of the adjustable seat base of FIG. 2A, disposed in the retracted position.

With reference now to FIGS. 2A and 2B, seat base 120 includes a pair of substantially parallel side support members 122 disposed on either side of seat base 120 and extending therealong. A seat member 124, e.g., a nylon upholstery, coupled to each of side support members 122 extends between side support members 122 to define a seating area for the patient. Seat member 124 includes a forward end 124*a*, a rear end 124*b* and first and second sides 125*a*, 125*b*. More particularly, the sides 125*a*, 125*b* of seat member 124 are folded over and secured to seat member 124 to define a lumen 126 at each side 125*a*, 125*b* of seat member 124. Each lumen 126 is configured to receive one of side support members 122 therein to secure seat member 124 to support members 122 on each side 125*a*, 125*b* thereof. Alternatively, sides 125*a*, 125*b* of seat member 124 may be configured in any other suitable fashion for securing seat member 124 to side support members 122 at each of the first and second sides 125*a*, 125*b* of seat member 124. Although the following describes only one side support member 122, it is understood that the same features apply similarly to the other side support member 122, but will not be discussed hereinbelow for purposes of brevity.

With continued reference to FIGS. 2A and 2B, side support member 122 includes an outer shaft 128 and an inner shaft 129 slidably receivable within the outer shaft 128. In other words, outer shaft 128 and inner shaft 129 of side support member 122 are configured for telescopic movement with respect to one another. As shown in FIGS. 2A and 2B, side support member 122 is disposed in a retracted position, i.e., wherein inner shaft 129 is substantially disposed within outer shaft 128. In this retracted position, side support member 122 defines a minimum length and, thus, seat base 120 defines a minimum depth "d." A set screw 130 is threadably engaged within an aperture 131 defined within outer shaft 128. Set screw 130, as shown in FIG. 2B, is tightened against the inner shaft 129 to fix the relative position of inner shaft 129 with respect to outer shaft 128 and, thus, to fix seat base 120 in the retracted position; however, other locking mechanisms, e.g., pin-aperture locking mechanisms, clevis fasteners, latching mechanisms etc., are also contemplated. As can be appreciated, upon loosening of set screw 130, i.e., upon disengagement of set screw 130 from inner shaft 129, inner shaft 129 is free to slide, or translate with respect to outer shaft 128 from the retracted position (FIGS. 2A-2B) to an extended position (FIGS. 3A-3B).

As best shown in FIG. 2B, an auxiliary portion 124*c* of seat member 124 extends from forward end 124*a* of seat member 124. Auxiliary portion 124*c* is tucked, or folded underneath seat member 124 when seat base 120 is disposed in the retracted position. Accordingly, first and second components 133*a*, 133*b* of a releasable securement mechanism 133, e.g., a VELCRO™ fastening mechanism, snaps, buttons, etc., may be provided on an under surface 134 of auxiliary portion 124*c* of seat member 124 and on an under surface 136 of forward end 124*a* of seat member 124, respectively, for releasably engaging auxiliary portion 124*c* of seat member to forward end 124*a* of seat member 124, i.e., for retaining auxiliary portion 124*c* in the folded, or stored position underneath seat member 124.

Figure 3A:
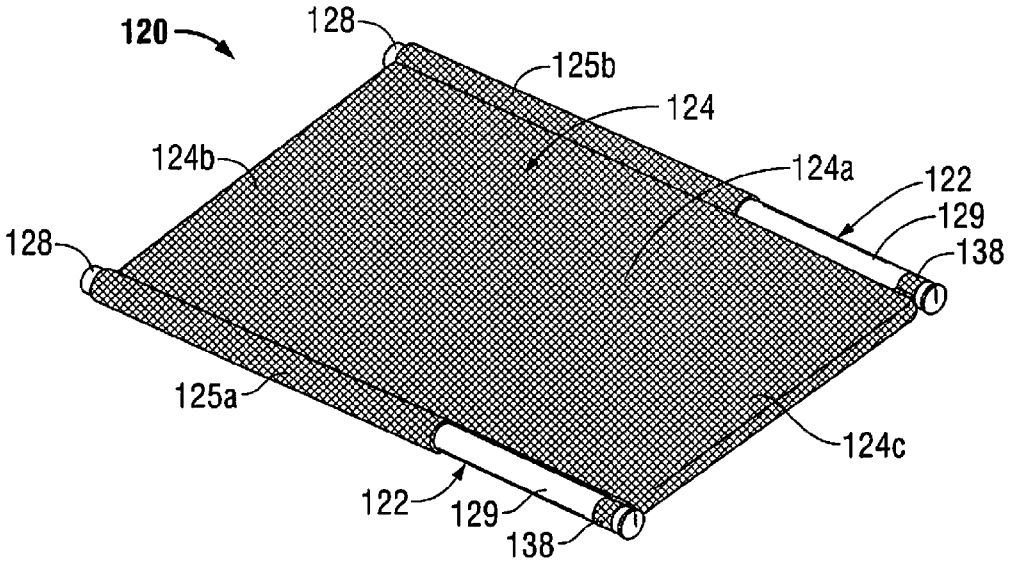
FIG. 3A is a perspective view of the adjustable seat base of FIG. 2A, disposed in an extended position.
Figure 3B:
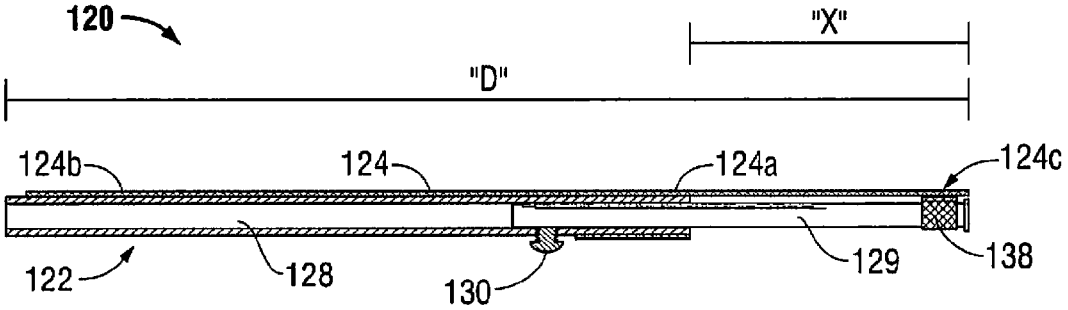
FIG. 3B is a side, cross-sectional view of the adjustable seat base of FIG. 3A, disposed in the extended position.

Turning now to FIGS. 3A and 3B, when it is desired to extend seat base 120 from the retracted position (FIGS. 2A-2B) to the extended position (FIGS. 3A-3B), auxiliary portion 124*c* is first released, or disengaged from the stored, or folded position underneath seat member 124. Next, set screw 130, as mentioned above, is loosened, or disengaged from inner shaft 129, such that inner shaft 129 may be translated with respect to outer shaft 128. Inner shaft 129 is then translated to the desired position, e.g., the extended position or any intermediate position therebetween, and set screw 130 is re-engaged, or re-tightened about inner shaft 129 to once again fix the relative position of inner shaft 129 with respect to outer shaft 128. As shown in FIGS. 3A and 3B, seat base 120 is disposed in an extended position wherein inner shaft 129 is substantially spaced-apart from outer shaft 128 such that side support member 122 defines a maximum length. In this extended position, seat base 120 defines a depth "D" that is greater than depth "d."

Straps 138, which extend outwardly from either side of auxiliary portion 124*c* of seat member 124, are then secured about the respective side support members 122 to secure auxiliary portion 124*c* in the use position, extending between side support members 122, as shown in FIGS. 3A and 3B. Straps 138 may include any suitable releasable securement mechanism, e.g., VELCRO™, snaps, buttons, etc., for securing auxiliary portion 124*c* to side support members 122. As can be appreciated, in the use position, auxiliary portion 124*c* forms the forward-most portion of seat member 124, thereby providing the additional depth "X" to seat member 124, as needed.

It is also envisioned that auxiliary portion 124*c* include multiple sets of straps (not shown) extending outwardly therefrom along a length thereof, or that auxiliary portion 124*c* include additional releasable securement mechanisms (not shown) for securing auxiliary portion 124*c* to side support members 122 when seat base 120 is disposed at intermediate positions between the retracted position (FIGS. 2A and 2B) and the extended position (FIGS. 3A and 3B), i.e., when sea base 120 defines a depth greater than depth "d" (FIG. 2B) but smaller than depth "D."

Figure 4A:
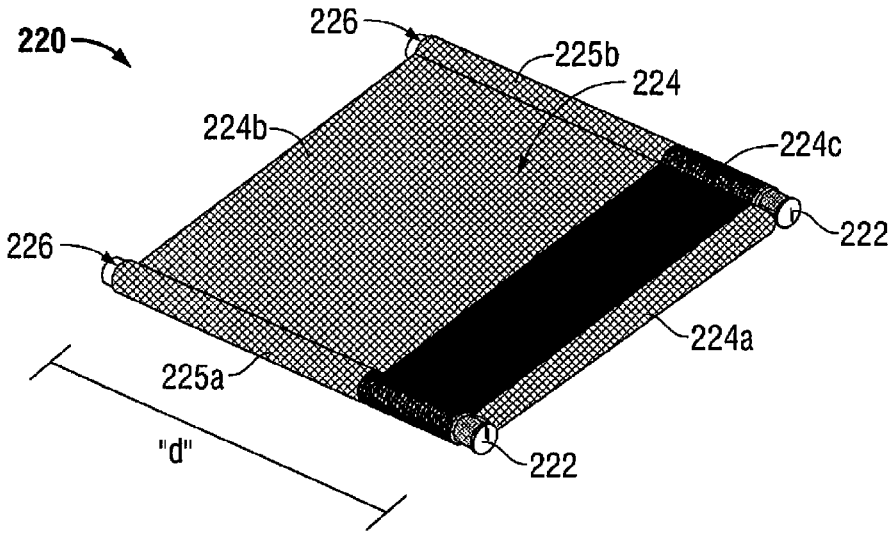
FIG. 4A is a perspective view of another embodiment of an adjustable seat base provided in accordance with the present disclosure and configured for use with the wheelchair of FIG. 1, wherein the seat base is disposed in the retracted position.
Figure 4B:
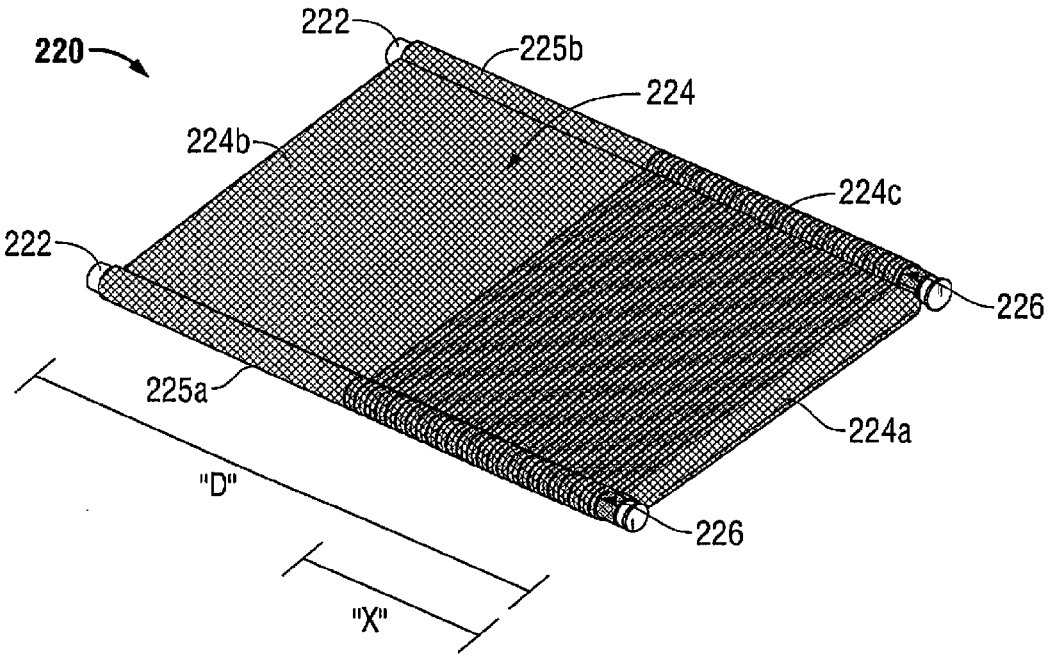
FIG. 4B is a perspective view of the adjustable seat base of FIG. 4A, disposed in the extended position.

Turning now to FIGS. 4A and 4B, another embodiment of an expandable seat base 220 is shown. Seat base 220 is substantially similar to seat base 120 and includes a pair of spaced-apart side support members 222 and a seat member 224 coupled to and extending between side support members 222. Side support members 222 are configured for expansion, e.g., telescopic expansion, between a retracted position defining a minimum length such that seat base 220 defines a minimum depth "d" (FIG. 4A) and an expanded position defining a maximum length such that seat base 220 defines a maximum depth "D" (FIG. 4B) (and intermediate positions therebetween).

More specifically, seat member 224 includes a forward end 224*a*, a rear end 224*b*, an auxiliary expandable, or accordion portion 224*c* intermediately disposed between forward end 224*a* and rear end 224*b*, and first and second sides 225*a*, 225*b*, respectively. Each of sides 225*a*, 225*b* defines a lumen 226 therethrough for reception of one of side support members 222 therein. Sides 225*a*, 225*b* of seat member 224 are also fixedly engaged to side support members 222 are each of the forward and rear ends 224*a*, 224*b*, respectively, thereof, e.g., via adhesive, snap-fitting, latching, etc. In other words, the four corners of seat member 224 are fixed with respect to side support members 222. Such a configuration permits, upon extension of side support members 222 from the retracted position (FIG. 4A) to the extended position (FIG. 4B), auxiliary expandable portion 224*c* to expand from a minimized or collapsed position shown in FIG. 4A to a maximized or expanded position shown in FIG. 4B (and positions therebetween) to thereby provide the additional depth "X" to seat member 224, as needed. Alternatively, straps (not shown) similar to straps 138 (FIGS. 3A-3B), or other suitable releasable securement mechanisms, may be provided for securing seat member 224 in position, i.e., for fixing expandable section 224*c* in the collapsed position, the expanded position, or positions therebetween.

Figure 5A:
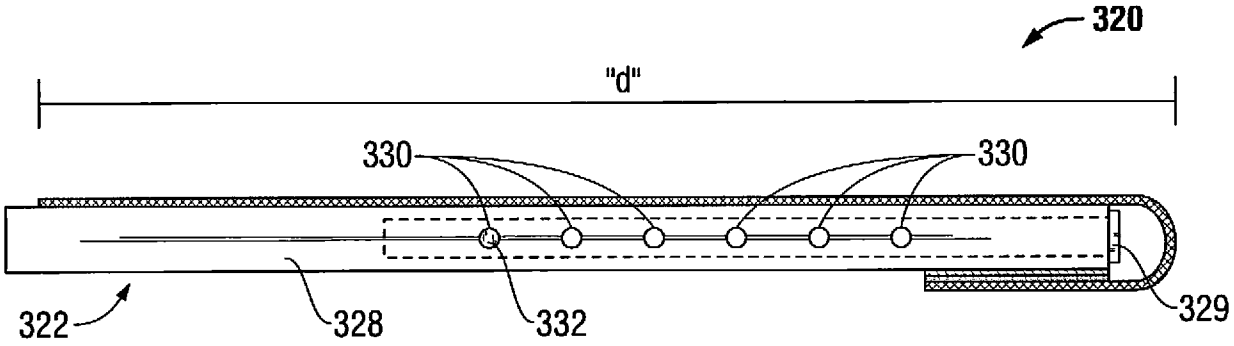
FIG. 5A is a side, cross-sectional view of another embodiment of the adjustable seat base, disposed in the retracted position.
Figure 5B:
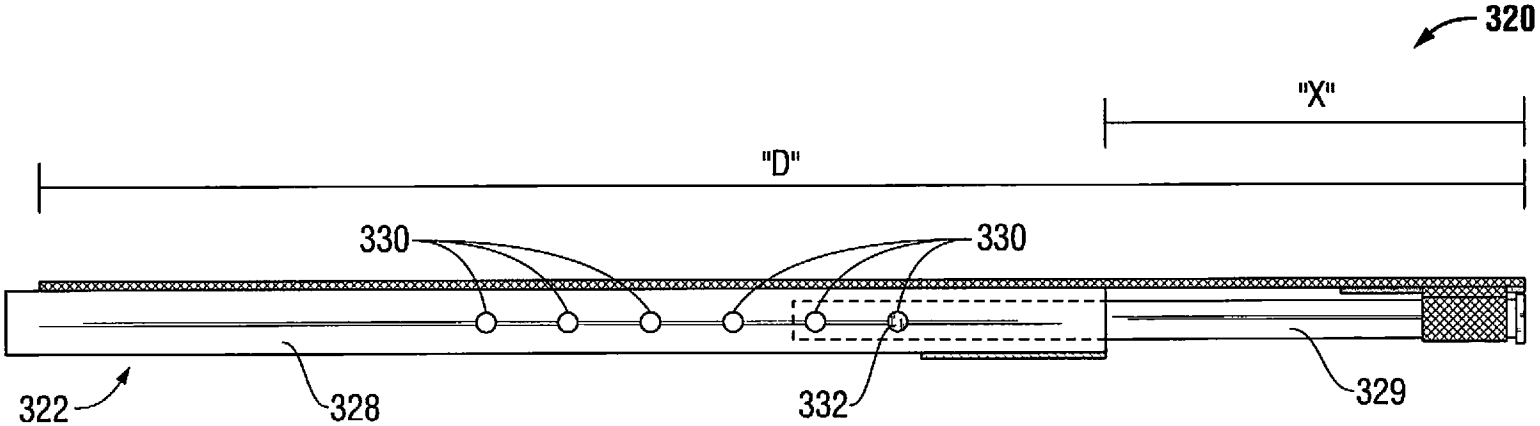
FIG. 5B is a side, cross-sectional view of the adjustable seat base of FIG. 5A, disposed in the extended position.

Turning now to FIGS. 5A-5B, another embodiment of an expandable seat base 320 is shown. Seat base 320 is similar to seat base 120 except that seat base 320 includes an alternative locking mechanism for fixing the position of inner shafts 329 with respect to outer shafts 328 of side support members 322. In the embodiment of FIGS. 5A-5B, a plurality of apertures 330 are defined within and are positioned along a length of each of the outer shafts 328, while inner shafts 329 each include a complementary locking pin 332, e.g., a spring biased locking pin 332, that is configured and dimensioned for releasable engagement within each of apertures 330. Accordingly, inner and outer shafts 329, 328, respectively, of side support members 322, may be releasably secured in a plurality of incremental positions, such that side support members 322 and, thus, seat member 324 of seat base 320 may be adjusted incrementally between the retracted position (FIG. 5A) wherein seat member 324 of seat base 320 defines a minimum depth "d," and the extended position (see FIG. 5B), wherein seat member 324 of seat base 320 defines a maximum depth "D." The incremental locking mechanism of seat base 320 may be used in conjunction with any of the other embodiments of discussed herein.

Figure 7:
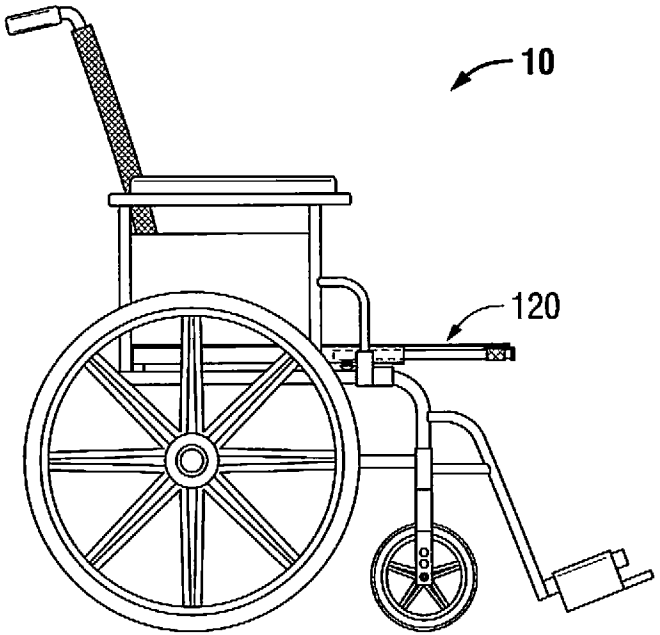
FIG. 7 is a side view of the wheelchair of FIG. 1, wherein the seat base is disposed in the extended position.
Figure 6:
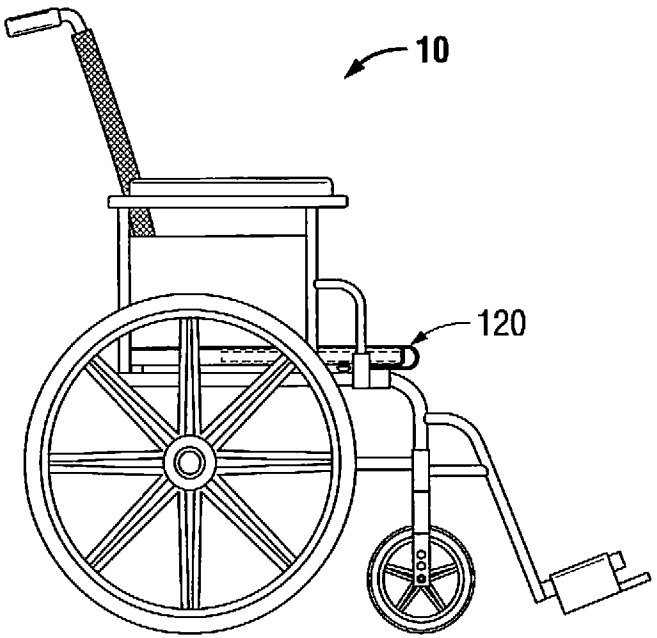
FIG. 6 is a side view of the wheelchair of FIG. 1, wherein the seat base is disposed in the retracted position.

With reference now to FIGS. 6 and 7 and, initially, to FIG. 6, wheelchair 10 is shown wherein seat base 120 is disposed in the retracted position. Such a configuration may be used for relatively smaller patients, patients with specific conditions requiring a lesser seat depth, or for other reasons, e.g., to promote proper posture. FIG. 7 shows wheelchair 10 wherein seat base 120 has been adjusted to the extended position to define an increased seat depth. This configuration may be useful for larger patients, patients with longer legs, or for other medical or non-medical reasons. As can be appreciated, the adjustable seat base 120 of wheelchair 10 allows wheelchair 10 to be adapted for use by a wide variety of patients having different physical characteristics and/or different medical conditions. As mentioned above, seat back 110 may similarly be adjustable between a minimum height and a maximum height (and positions therebetween) to further accommodate the needs of the patient, e.g., taller or shorter patients, patients requiring additional head/neck support, etc. The adjustment mechanisms for seat back 110 may be similarly to any of the adjustment mechanisms discussed hereinabove.

From the foregoing and with reference to the various figure drawings, those skilled in the art will appreciate that certain modifications can also be made to the present disclosure without departing from the scope of the same. While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A method of adjusting a seat of a wheelchair, comprising:

transitioning an auxiliary portion of a seat member of the seat of the wheelchair from a storage position, wherein the auxiliary portion is stored underneath the seat member, to a use position, wherein the auxiliary portion extends forwardly from the seat member;

extending a seat frame of the seat of the wheelchair from a first position defining a first length to second position defining a second length greater than the first length, wherein the auxiliary portion is transitioned from the storage position to the use position before extending the seat frame from the first position to the second position; and attaching the auxiliary portion to the extended seat frame.

2. The method according to claim 1, wherein the seat frame includes first and second side support members, and wherein extending the seat frame includes extending each of the first and second side support members from the first position wherein the first and second side support members define the first length to the second wherein the first and second side support members define the second length.

3. The method according to claim 2, wherein attaching the auxiliary portion includes attaching first and second releasable straps of the auxiliary portion to the first and second side support members, respectively.

4. The method according to claim 1, wherein extending the seat frame includes unlocking the seat frame from the first position, extending the seat frame from the first position to the second position, and locking the seat frame in the second position.

5. The method according to claim 1, wherein transitioning the auxiliary portion initially includes disengaging the auxiliary portion from underneath the seat member.

6. A method of adjusting a seat of a wheelchair, comprising:

telescopically extending first and second side support members of a seat frame of the seat of the wheelchair from a retracted position to an extended position; and attaching an auxiliary portion of a seat member of the seat of the wheelchair to the extended first and second side support members, thereby extending a depth of the seat member, wherein attaching the auxiliary portion includes attaching first and second releasable straps of the auxiliary portion to the first and second side support members, respectively.

7. The method according to claim 6, wherein attaching the auxiliary portion initially includes transitioning the auxiliary portion from a storage position to a use position.

8. The method according to claim 7, wherein transitioning the auxiliary portion from the storage position to the use position initially includes disengaging the auxiliary portion from an underside of the seat member.

9. The method according to claim 6, wherein telescopically extending first and second side support members includes unlocking the side support members from the retracted position, telescopically extending the side support members, and locking the side support members in the extended position.

* * * * *